United States Patent [19]

Budzich

[11] Patent Number: 4,688,470

[45] Date of Patent: Aug. 25, 1987

[54] COMPENSATED FLUID FLOW CONTROL VALVE

[75] Inventor: Tadeusz Budzich, Moreland Hills, Ohio

[73] Assignee: Caterpillar Inc., Peoria, Ill.

[21] Appl. No.: 887,586

[22] Filed: Jul. 21, 1986

[51] Int. Cl.[4] ..... F15B 13/02

[52] U.S. Cl. ..... 91/420; 91/446; 91/447; 137/596.1; 137/596.13

[58] Field of Search ..... 60/452; 91/420, 446, 91/447; 137/596.1, 596.13

[56] References Cited

U.S. PATENT DOCUMENTS 3,882,896 5/1975 Budzich ..... 137/596.1
4,222,409 9/1980 Budzich ..... 137/596.13
4,487,018 12/1984 Budzich ..... 60/452

*Primary Examiner*—Gerald A. Michalsky
*Attorney, Agent, or Firm*—J. W. Burrows

[57] ABSTRACT

A compensated control valve assembly for control of fluid flow to and from a fluid motor, which may be of a cylinder type and is subjected to positive and negative loads. During control of negative load the controlled pressure level of a pressure reducing valve mechanism handling the fluid flow at negative load pressure is varied upstream of an outflow metering orifice arrangement, positioned at the outlet of the fluid motor, in response to pressure at the inlet of the fluid motor, while maintaining this controlled pressure constant at each specific level. The pressure differential across an inflow metering orifice arrangement, positioned at the inlet of the fluid motor, is maintained at a constant preselected level by a positive load pressure compensating control device.

30 Claims, 6 Drawing Figures

47
W
11
48
41
42
26
27
39
144
146
21
146A
145
152
143
29
25
28
151
157
158
38
142
147
153
141
150
156
149
135
137
136
138
55
55
70
148
55A
134
55A
155
154
132
140
133
74
51
84
86
114
16

COMPENSATED FLUID FLOW CONTROL VALVE

BACKGROUND OF THE INVENTION

This invention relates generally to load responsive fluid control valves and to fluid power systems incorporating such valves, which systems are supplied by a single fixed or variable displacement pump. Such control valves are equipped with an automatic load responsive control and can be used in a multiple load system in which a plurality of loads is individually controlled under positive and negative load conditions by separate control valves.

In more particular aspects this invention relates to direction and flow control valves capable of controlling simultaneously a number of loads, under both positive and negative load conditions.

In still more particular aspects this invention relates to direction and flow control valves, which use a pressure reducing valve in control of negative load.

In still more particular aspects this invention relates to automatic synchronizing controls for synchronization of the compensating and throttling action of positive load compensator and negative load pressure reducing valve, in controlling fluid flow in and out of fluid motors of a cylinder piston rod type.

In still more particular aspects this invention relates to negative load compensating control of a compensated direction control valve, in which the negative load throttling action in a pressure reducing valve is responsive to the fluid motor inlet pressure, generated by the pump.

Closed center load responsive fluid control valves, of a fully compensated type, are very desirable for a number of reasons. They permit load control with reduced power loss and therefore, increased system efficiency and when controlling one load at a time provide the feature of flow control, irrespective of variation in the magnitude of the load. Such valves are normally provided with positive and negative load compensating controls, which automatically maintain a constant pressure differential and therefore constant flow characteristics, through the metering control orifices handling the flow in and out of the fluid motor. A fluid control valve using a pressure reducing valve in control of negative load is shown in FIG. 3 of my U.S. Pat. No. 3,882,896 issued May 13, 1975. however, such fully compensated control valves suffer from one basic disadvantage, when controlling fluid flow to and from an actuator, in the form of a cylinder, which, due to the well know piston rod effect, is characterized by different flow rates between the in and out flows of the cylinder. Depending on the direction of actuation such cylinders, when controlled by the valve of U.S. Pat. No. 3,882,896, can be subjected either to cavitation, or excessive pressures, due to the energy derived from the pump circuit during control of negative load.

This drawback can be overcome in part by the provisions of the fully compensated proportional valves disclosed in my U.S. Pat. No. 4,222,409, issued Sept. 16, 1980. In this compensated control valve, during negative load control, the pump circuit is automatically isolated from the cylinder, preventing generation of excessive pressures, while the cavitation condition is prevented by fluid flow from the pressurized exhuast manifold. This type of control, although very effective, suffers from one serious disadvantage in applications requiring high control stiffness and high frequency response. Those harmful characteristics result from the fact that the energy derived from the pump cannot be directly applied to both ends of the actuator, without going through the stage of isolating the actuator from the pump, during control of negative load. Therefore, such a valve would display some undesirable characteristics, when used as a proportional, or servo valve, in servo systems controlling loads.

SUMMARY OF THE INVENTION

It is therefore a principal object of this invention to vary the controlled pressure level of pressure reducing valve controlling the fluid flow out of a cylinder, in response to the pressure developed at the metering orifice supplying the cylinder inlet, to prevent build-up of excessive pressures in the actuator, during control of negative load.

Another object of this invention is to synchronize the flow control action of the positive load compensator and of a pressure reducing valve handling the flow out of the actuator, in control of all types of actuators, by variation in the level of the controlled pressure upstream of the negative load metering slots, while the pressure differential across the positive load metering slots remains constant at a preselected level.

It is a further object of this invention to provide a flow compensated direction control valve, for control of positive and negative load, which permits the use of positive load compensation and throttling of negative load pressure by a pressure reducing valve in control of cylinder type actuators, while making cavitation within the actuator impossible and automatically guarding against excessive pressures, developed in the actuator, especially during control of negative loads.

It is a further object of this invention to provide a synchronizing control of the action of the positive load compensator and of a pressure reducing valve handling the flow out of the actuator, which automatically compensates for variation between the in and out flow of the actuator, while also compensating for the timing of the direction and flow control metering slots of the direction control spool, during control of both positive and negative loads.

It is a further object of this invention to provide a synchronizing control of the positive load compensator and a negative load pressure reducing valve, which during control of positive load automatically deactivates the negative load pressure reducing valve by maintaining its throttling spool in a fully open position resulting in minimum throttling loss and making interaction between individual positive and negative load controls impossible.

It is a further object of this invention to limit, by the positive load compensator, the cylinder inlet pressure to a certain low pressure level, during control of negative load, to eliminate the possibility of cavitation, ensure high system efficiency and prevent generation of excessive pressures in the cylinder.

It is a further object of this invention to provide a synchronizing control of the positive load compensator and the negatiave load pressure reducing valve in which the flow through the positive load metering slots becomes a dominant factor and always takes place at a constant pressure differential, during control of positive and negative load.

It is a still further object of this invention to provide a synchronizing control, which automatically varies, during control of negative load, the level of the control pressure of the negative load pressure reducing valve to maintain the cylinder inlet pressure at a certain minimum relatively constant pressure level.

Briefly the foregoing and other additional objects and advantages of this invention are accomplished by providing a novel load responsive, fully compensated fluid control valve, in which, during control of negative load, the pressure at the positive load metering slot regulates the magnitude of the level of the controlled pressure of the negative load pressure reducing valve, preventing not only an undesirable build-up of the negative load pressure, but also ensuring that the flow to the other end of the cylinder is supplied at a certain minimum positive pressure level, preventing any possibility of cavitation, compensating for different rates of flow in and out of the actuator and timing of the metering slots of the direction control spool, while also ensuring minimum pump loss, during control of negative load.

Additional objects of this invention will become apparent when referring to the preferred embodiments of this invention as shown in the accompanying drawings and described in the following detailed description.

DESCRIPTION OF THE PREFERRED EMBODIMENTS

Figure 1:
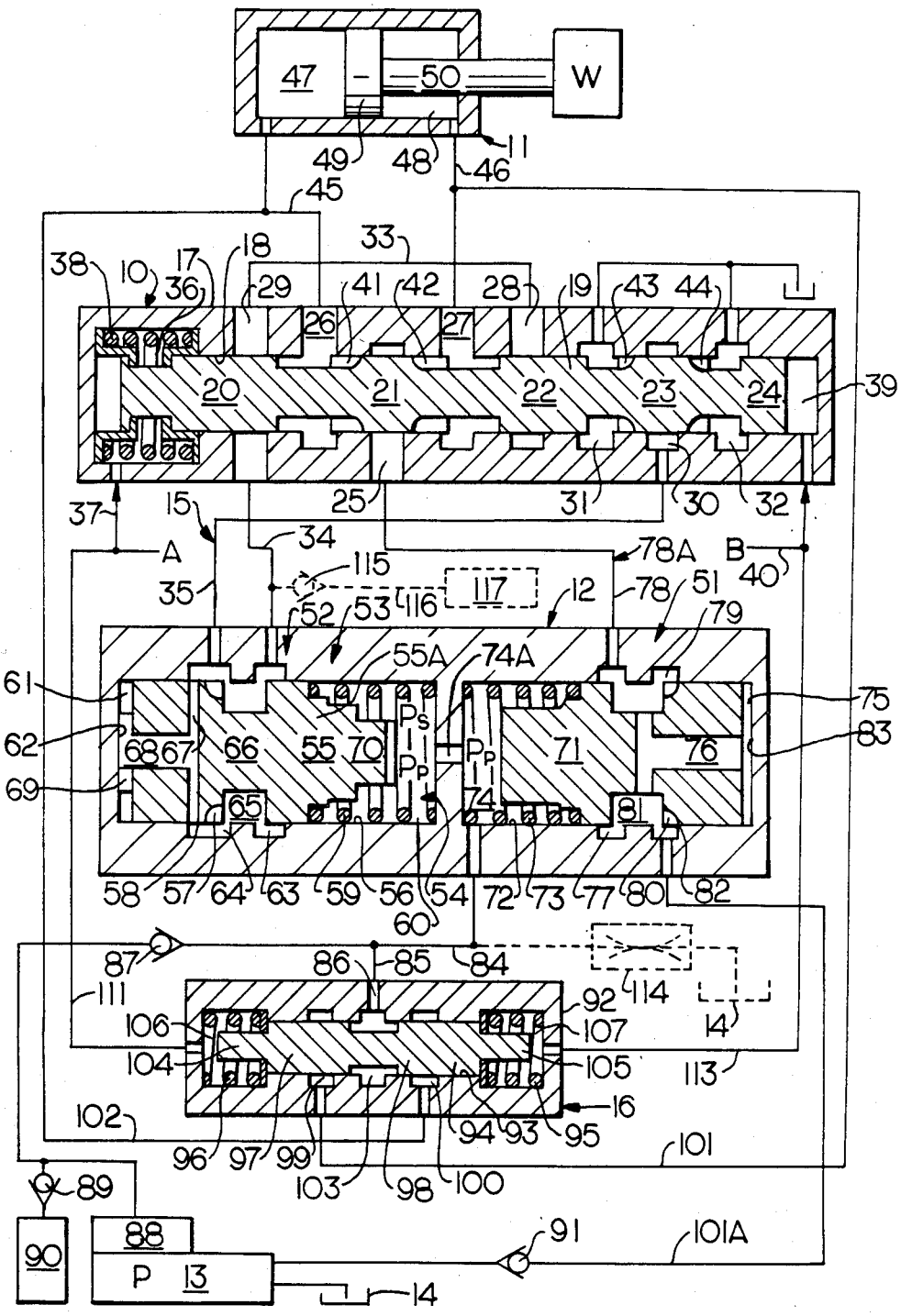
FIG. 1 is a longitudinal sectional view of an embodiment of a single stage flow compensated direction control valve responding to a hydraulic control signal, together with a sectional view of pressure compensated controls including positive load compensator and negative load pressure reducing valve and a sectional view of load pressure signal identifying and transmitting valve, with schematically shown compensator and pressure reducing valve energizing controls, system pump, actuator in the form of a cylinder and system reservoir, all connected by schematically shown system fluid conducting lines.

Referring now to FIG. 1, an embodiment of a valve assembly including a first valve means, such as, a direction and flow control valve, generally designated as 10, is shown interposed between a fluid motor of a cylinder type, generally designated as 11 and a compensating control assembly, generally designated as 12 supplied with fluid power from a source of pressure, such as, a pump 13 and connected to a reservoir means, such as, a system reservoir 14, which constitutes a part of an exhaust means, generally designated as 15. A logic means, such as, an external logic module, generally designated as 16, is functionally interconnected to the flow control valve 10 and compensating control assembly 12 for identification and transmittal of load pressure signals.

The flow control valve 10 is of a four way type and has a housing 17 provided with a bore 18 axially guiding a valve spool means, such as, a spool 19. The valve spool 19 is provided with lands 20, 21, 22, 23 and 24, which in neutral position of valve spool 19, as shown in FIG. 1, isolate a fluid supply chamber 25, load chambers 26 and 27 and first outlet chambers 28 and 29, second outlet chamber 30 and two exhaust chambers 31 and 32 connected by lines 33, 34 and 35 to the exhaust system 15. The land 20 of the valve spool 19 protrudes into a control chamber 36 subjected to pressure of control signal 37 and engages a centering spring assembly 38, well known in the art. The land 24 of the valve spool 19 protrudes into a control chamber 39, which is subjected to pressure of control signal 40. The lands 21 and 23 of the valve spool 19 are provided with fluid inflow metering orifice means, such as, inflow or positive load pressure metering slots 41 and 42 and with fluid outflow metering orifice means, such as, outflow, or negative load pressure metering slots 43 and 44.

The load chambers 26 and 27 are connected by lines 45 and 46 with cylindrical spaces 47 and 48 of the fluid motor 11, which are separated by piston 49 connected by a piston rod 50 with load W.

The compensating control assembly 12 is equipped for compensation of both positive and negative loads and is provided with positive load pressure compensating control means, generally designated as 51, and a negative load pressure control means, generally designated as 52, which is provided with a means for reducing pressure, such as, a pressure reducing valve, generally designated as 53.

The pressure reducing valve 53, operable during control of negative load, is provided with throttling member means, such as, a throttling member 55 axially slidable in bore 56, provided with throttling slot means 57 provided with blocking edges 58 and biased by control spring 59, located in a second control chamber 60. One end of the throttling member 55 is subjected to pressure in a third control chamber 61 and in position as shown in FIG. 1 abuts against surface 62, while an inlet chamber 63 and an exhaust chamber 64 are fully interconnected through annular space 65 defined by bore 56 and stem 66, while the throttling slots 57 remain in a fully open non-throttling position. The exhaust chamber 64 is connected through passages 67 and 68 and slot 69 with the third control chamber 61. The throttling member 55 is provided with an extension 70 protruding into the second control chamber 60. The inlet chamber 63 is connected by line 34 with the outlet chambers 29 and 28, while the exhaust chamber 64 is connected by line 35 with the second outlet chamber 30 and therefore with the exhaust system 15.

The pressure reducing valve 53 is provided with a deactivating means, generally designated as 54, which consists of a combination of a force generating means, such as, the force generating circular area 55*a* of the extension 70, subjected to Pp pressure in the second control chamber 60 and the biasing force of the control spring 59. During control of positive load those two forces when combined are greater than the force generated by pressure in the third control chamber 61, acting on the cross-sectional area of the throttling member 55, maintaining it in a fully open deactivated position, as shown in FIG. 1. The force generating means 55*a* and second control chamber 60 make up a regulating means while the force generating means 55*a*, second control chamber 60, third control chamber 61, and spring 59 make up a force limiting means.

The positive load pressure compensated control 51 is provided with a throttling member 71, guided in a bore 72, biased by control spring 73 and subjected on its cross-sectional area to the pressure Pp in the fourth control chamber 74 and pressure Ps in the fifth control chamber 75. The fourth control chamber 74 is connected by passage 74*a* to the second control chamber 60. The fifth control chamber 75 is connected by a passage 76 with the second fluid supply chamber 77, which in turn is connected by line 78 with the fluid supply chamber 25. The inlet chamber 79 is functionally interconnected through fluid throttling slot means, such as, positive load throttling slots 80 and annular space 81 with the second fluid supply chamber 77. The throttling member 71, spring 73 and slots 80 make up a throttling means. The positive load throttling slots 80 are provided with cut-off edges 82. The end of the throttling member 71, protruding into the fifth control chamber 75, abuts against surface 83 in a non-throttling position as shown in FIG. 1. The fourth control chamber 74 is connected by lines 84 and 85 with a positive load signal port 86 of the external logic module, generally designated as 16. The positive load signal port 86 is also connected through lines 85 and 84 and check valve 87 with the load responsive control 88 of the pump 13. The check valve 89, in a well known manner, connects the positive load pressure signals to the load responsive control 88 from schematically shown load sensing system 90. The pump 13 is connected by load check 91 and line 101*a* to the inlet chamber 79. A first transmitting means is made up of signal port 86, lines 84,85 and passage 74*a* while a second transmitting means is made up of the signal port 86, line 85 and check valve 87.

A positive load pressure control means 78*a* may be of a form, in which the pressure from the pump 13, provided with an output flow control, such as, the load responsive control 88, is directly throttled in the inflow metering slots 41 and 42, or may be in the form in which a positive load pressure compensated control, generally designated as 51, is interposed between the pump 13 and the inflow metering slot 41 or 42.

The external logic module 16 has a housing 92, provided with a bore 93, slidably guiding load pressure identifying means, such as, a shuttle 94, biased by springs 95 and 96, towards neutral position, as shown in FIG. 1, in which lands 97 and 98 isolate chambers 99 and 100. The chamber 99 is connected by line 101 with cylindrical space 48. The chamber 100 is connected by line 102 with the cylindrical space 47. The load pressure identifying shuttle 94 defines annular space 103 and protrudes with its ends 104 and 105 into chambers 106 and 107. The chamber 106 is connected by line 111 with control chamber 36. The chamber 107 is connected by line 113 with control chamber 39. From annular space 103 and positive load signal port 86, the identified positive load pressure signal, at positive load pressure Pp, is transmitted through line 84 to the fourth control chamber 74 and through the passage 74*a* to the second control chamber 60.

The positive load signal port 86 is connected through lines 85 and dotted extension of line 84 with a compensation energizing means, such as, a leakage control 114, connected to reservoir 14.

The inlet chamber 63, of the pressure reducing valve 53, is connected through line 34 and check valve 115 and line 116 to the energizing means 117 which is connected to the source 13 of pressure fluid.

Figure 2:
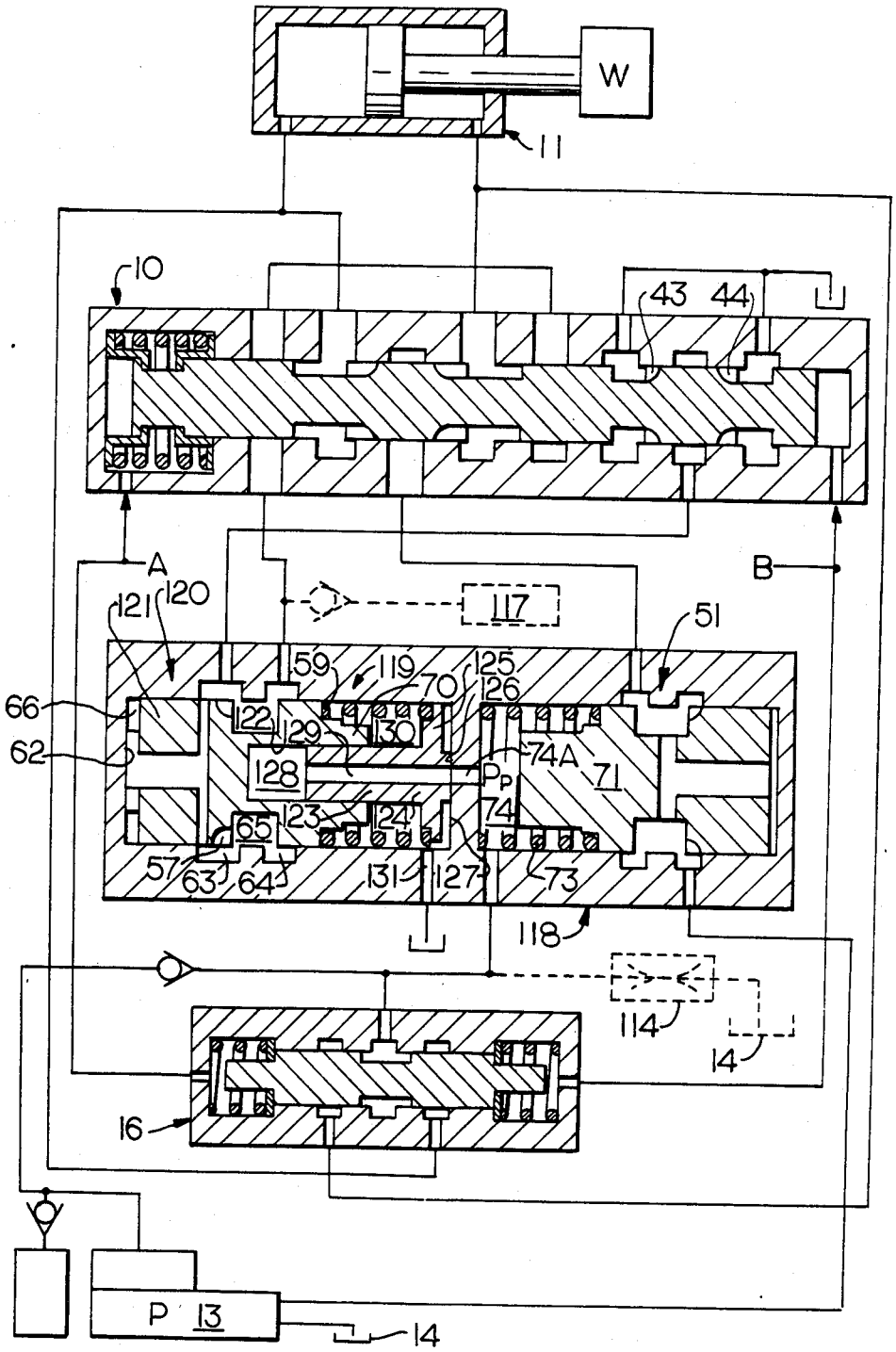
FIG. 2 is a longitudinal sectional view of an embodiment of single stage compensated direction control valve, together with a sectional view of pressure compensated controls, including positive load compensator of FIG. 1 and a modified negative load pressure reducing valve and a sectional view of a load pressure signal identifying and transmitting valve with schematically shown compensator and pressure reducing valve energizing controls, system pump, actuator in the form of a cylinder and system reservoir, all connected by schematically shown system fluid conduit lines.

Referring now to FIG. 2 the fluid power and control circuit of FIG. 2 and its basic control components are very similar to those of FIG. 1 and like components of FIGS. 1 and 2 are designated by like numerals.

The fluid motor 11, the direction and flow control valve 10, the external logic module 16 and all of the other schematically shown system components of FIG. 2 are identical to those of FIG. 1 and perform identical functions. The compensating control assembly 118 of FIG. 2 is to some extent different from that of FIG. 1, although it includes an identical positive load pressure compensated control 51. A negative load pressure control of FIG. 2, generally designated as 119, includes a pressure reducing valve, generally designated as 120, which is provided with a throttling member 121, very similar to the throttling member 55 of FIG. 1. The throttling member 121 is provided with bore 122 in its extension 70, which slidably guides the cylindrical section 123 of a reaction piston 124. The reaction piston 124 is provided with spring retaining flange 125, which terminates in sealing surface 126, abutting against reaction surface 127, in sealing engagement around the passage 74*a*. The passage 74*a* is connected with space 128 by a passage 129. The reaction piston 124 and space 128 make up the regulating means of FIG. 2. The control spring 59 is interposed between the spring retaining flange 125, of the reaction piston 124 and the throttling member 121. A chamber 130, containing the reaction piston 124 and the control spring 59, s vented to reservoir 14 by port 131.

Figure 3:
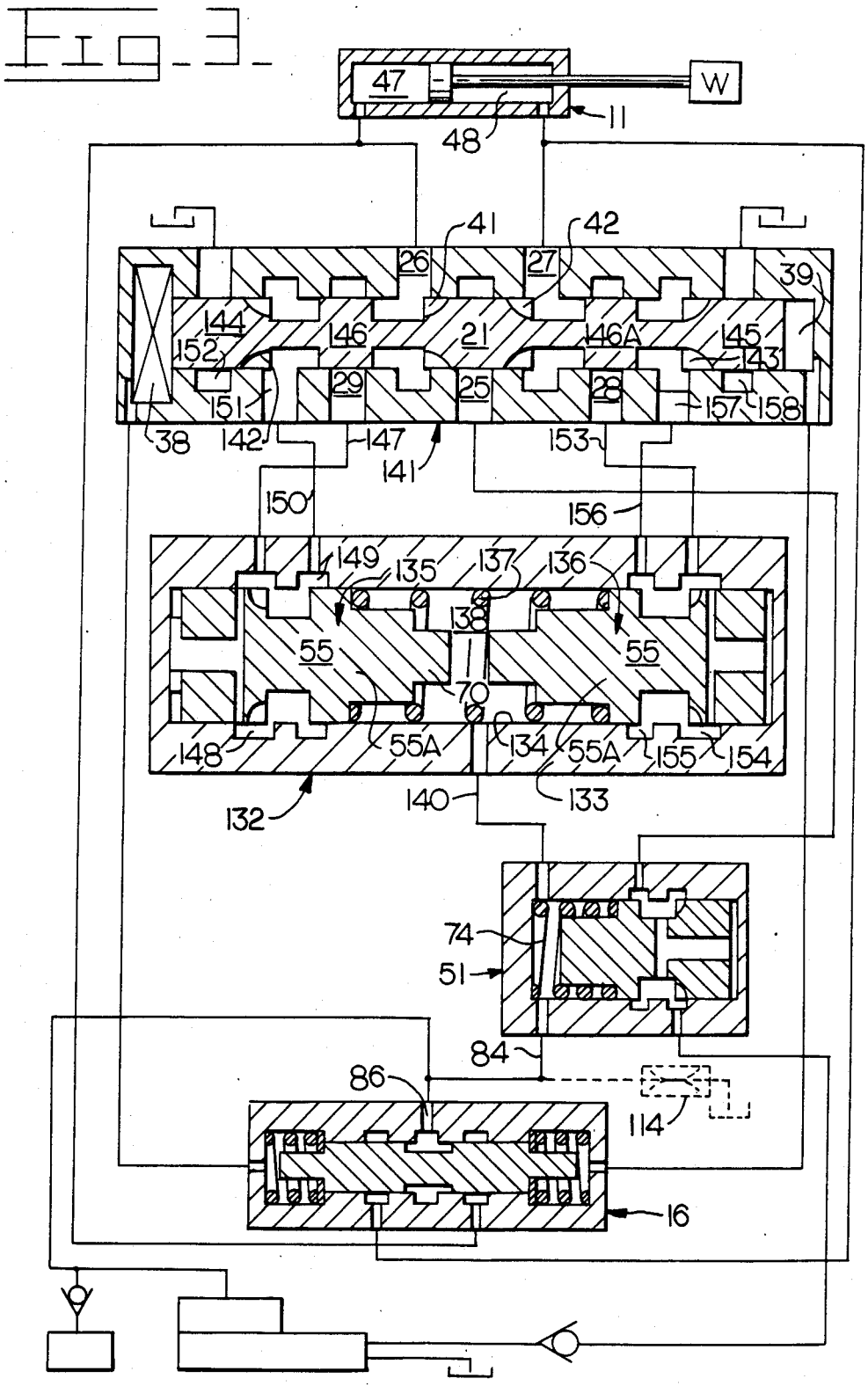
FIG. 3 is a longitudinal sectional view of an embodiment of a single stage compensated direction control valve responding to a hydraulic control signal, sectional view of negative load controls including two pressure reducing valves, together with a section view of positive load pressure compensated controls and a sectional view of load pressure signal identifying and transmitting valve, with schematically shown system pump, actuator in the form of a cylinder and system reservoir, all connected by schematically shown system fluid conducting lines.

Referring now to FIG. 3, the fluid power and control circuit of FIG. 3 and its basic control components are very similar to those of FIG. 1 and like components are designated by like numerals.

The external logic module 16 and the positive load compensating control 51 of FIG. 3 are identical to those of FIG. 1, although the positive load compensating control of FIG. 3 is shown as a self-contained unit. A negative load pressure control 132 is provided with a housing 133, which in a bore 134 slidably guides two pressure reducing valves, generally designated as 135 and 136, and which are identical, in their construction and operation, to the pressure reducing valve 53 of FIG. 1. A spring biasing means, such as, a control spring 137 in a second control chamber 138 is interposed between the throttling members 55. The distance between extensions 70 of throttling members 55, is so selected that it is equal to the control stoke of individual throttling members 55. The second control chamber 138 is connected with positive load signal port 86 of the external logic module 16 through line 84, the fourth control chamber 74 and line 140.

The direction and flow control valve, generally designated as 141, is similar to flow control valve 10 of FIG. 1. The basic difference between the flow control valves 10 and 141 of FIGS. 1 and 3 is in the location of outflow or negative load throttling slots 142 and 143, which instead of being located on a single land 23 of valve spool 19, are located on individual lands 144 and 145, of valve spool 146. The outlet chamber 29 is connected by line 147 to a chamber 148, while a chamber 149 is connected by line 150 to a chamber 151, located upstream of outlet or negative load throttling slot 142, which meters fluid to an exhaust chamber 152. The outlet chamber 28 is connected by line 153 to a chamber 154, while a chamber 155 is connected by line 156 to a chamber 157, located upstream of outlet or negative load throttling slot 143, which meters fluid to an exhaust chamber 158.

Figure 4:
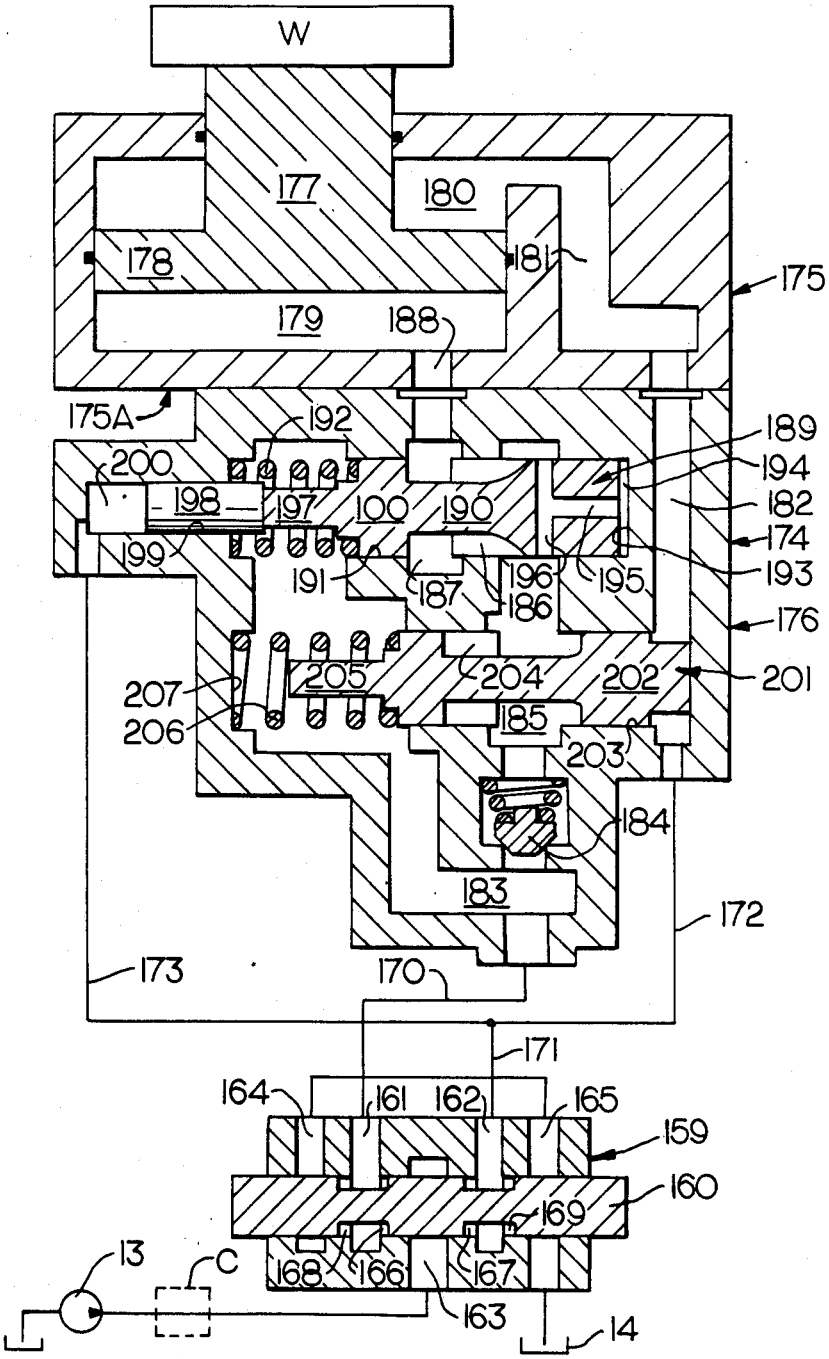
FIG. 4 is a longitudinal sectional view of an embodiment of a single stage compensated direction control valve, together with a sectional view of negative load pressure reducing controls directly mounted on cylinder type actuator with schematically shown positive load compensator control, system pump and system resesrvoir, all connected by schematically shown system fluid conducting lines.

Referring now to FIG. 4, the fluid power is supplied to a direction control valve assembly, generally designated as 159, from the pump 13, through a positive load compensating control C. A valve spool 160 of the direction control valve 159, sequentially interconnects load chambers 161 and 162 with a supply chamber 163 and outlet chambers 164 and 165, connected to the reservoir 14. The valve spool 160 is provided with positive load pressure metering slots 166 and 167 and negative load pressure metering slots 168 and 169. The direction control valve assembly 159 is connected by lines 170, 171, 172 and 173 to a fluid motor assembly, generally designated as 174, which consist of fluid motor, generally designated as 175 and a negative load pressure control, generally designated as 176 which are connected by mounting means 175*a*.

A fluid motor assembly 174 is subjected to a unidirectional load W, acting in a downward direction and connected by a piston rod 177 to a piston 178, which divides the cylindrical spaces 179 and 180. The cylindrical space 180 is connected by passages 181 and 182 to line 172. The line 170 is connected through a chamber 183, a check valve 184, a chamber 185, throttling ports 186, a chamber 187 and passage 188 to the cylindrical space 179 of the fluid motor 175.

The negative load pressure reducing valve, generally designated as 189, is provided with a throttling member 190, slidably guided in bore 191 and biased by a spring 192, towards engagement with surface 193 in third control chamber 194, which is connected by passages 195 and 196 with the chamber 185. The throttling member 190, through its extension 197, is selectively engageable by a force input piston 198, slidably guided in bore 199, which terminates in space 200, connected to line 173.

The connecting valve, generally designated as 201, is provided with connecting spool 202, slidably guided in bore 203 to form a fluid blocking means. The connecting spool 202 is provided with connecting ports 204 and stop 205 and is biased towards its closed position, as shown, by spring 206. The stop 205 selectively engages surface 207.

Figure 5:
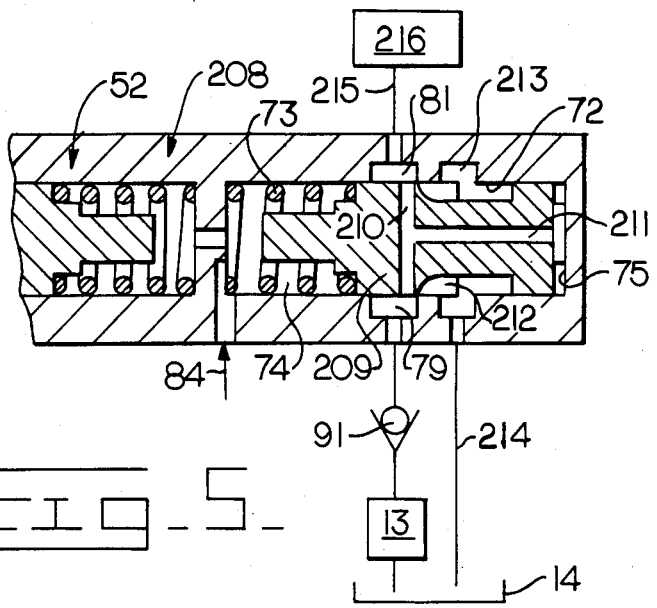
FIG. 5 is a partial sectional view of a positive load compensator of a bypass type with other system components shown schematically.

Referring now to FIG. 5, the positive load pressure compensating control means is shown as a partial section of the compensating control assembly, generally designated as 208, and is very similar to the compensated control assembly 12 of FIG. 1 and includes identical negative load pressure control 52 and the pressure reducing valve 53 (FIG. 1), used in the control of negative load. The pump 13, through the load check 91, is connected to the inlet chamber 79. The throttling and bypass member 209, guided in bore 72 towards position as shown, is biased by the control spring 73, positioned in the fourth control chamber 74. The inlet chamber 79 is connected by drillings 210 and 211 with the fifth control chamber 75. Bypass throttling means, such as, throttling and bypass slots 212 are positioned between the inlet chamber 79 and an exhaust chamber 213, which is connected by line 214 to the system reservoir 14. The inlet chamber 79 is connected by line 215 to schematically shown direction control valve assembly 216, which can be identical to the direction and flow control valve 10 of FIG. 1, or the direction and flow control valve 141 of FIG. 3.

Figure 6:
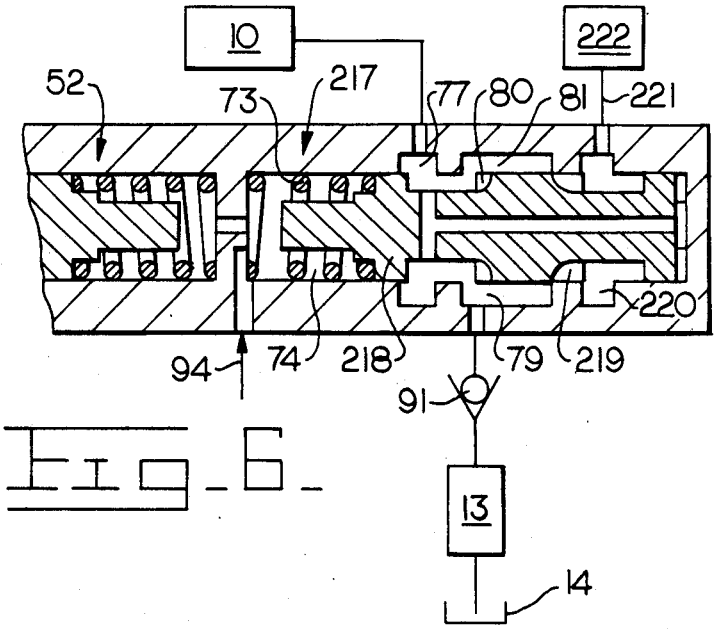
FIG. 6 is a partial sectional view of a positive load compensator of a throttling and bypass type, for use in series type circuits, with series type circuit and other system components shown schematically.

Referring now to FIG. 6, the positive load pressure compensating control means is shown as a partial section of the compensating control assembly, generally designated as 217, and is very similar to the compensator control assembly of FIG. 1 and includes the identical negative load pressure control 52 and the pressure reducing valve 53 (FIG. 1), used in control of negative load. A throttling and bypass member 218 is provided with positive load throttling slots 80 and bypass throttling means, such as, slots 219. The bypass and throttling slots 219 are positioned between the inlet chamber 79 and a bypass chamber 220, which is connected by line 221 to a downstream series power circuit 222, well known in the art.

Referring now back to FIG. 1, the fluid motor 11 is of a cylinder type and is coupled, through the piston rod 50, to the load W, which may be of an opposing or positive, or an aiding or negative type. The fluid flow to and from the fluid motor 11 is controlled by a direction and flow control valve, generally designated as 10, which has its load chambers 26 and 27 connected by lines 45 and 46 to cylindrical spaces 47 and 48 of the fluid motor 11. In a well known manner, the displacement of the valve spool 19, in either direction from its neutral position, as shown in FIG. 1, will connect the load chambers 26 and 27 with either the fluid supply chamber 25, or outlet chambers 28 and 29, which are connected by line 78 to the source of pressure fluid and through lines 33 and 34 to the exhaust system.

The valve spool 19 is biased towards its neutral position as shown in FIG. 1, by the centering spring assembly 38, the preload of which determines the pressure level, necessary to displace the valve spool 19 from its neutral position. Any increase in the pressure level, in control chambers 36 and 39 above that, equivalent to the preload of the centering spring assembly 38, will, in a well known manner, displace the valve spool 19 in either direction, the displacement of the valve spool 19 being directly proportional to the pressure of control pressure signal 37 or 40, which is generated by the spool position control system, not shown. During displacement of the valve spool 19, from its neutral position in either direction, the fluid, subjected to the pressure in the supply chamber 25, will be throttled by the inflow or positive load pressure metering slots 41 or 42, on its way to the load chamber 26 or 27 and on the way to the inlet of the fluid motor 11, while the fluid from the outlet of the fluid motor 11 connected with the load chamber 26 or 27, will be throttled, on its way to the outlet chamber 28 or 29, by the outflow or negative load pressure metering slots 43 or 44.

The identification of whether, during the control of the load W, the load chamber 26 or 27 is subjected to positive load pressure, is accomplished by external logic module, generally designated as 16. The direction of the load W will determine whether the load chamber 26 or 27 is subjected to load pressure. The desired direction of displacement of the load W, in respect to the direction of its force will establish whether the load W, being controlled at an instant, is of a positive or opposing type. Therefore, for any specific direction of the force, developed by the load W, generation of the control pressure signal 37 or 40 will automatically establish the characteristics of the load. The control pressure signal 37 or 40 is transmitted through lines 111 and 113 to the chamber 106 or 107, causing full displacement, in either direction of the load pressure identifying shuttle 94. The preload of the springs 95 and 96 is so selected that full displacement of the load pressure identifying shuttle 94 will take place before the valve spool 19, biased towards neutral position by the centering spring assembly 38, is displaced, providing the so-called feature of anticipation. The displacement of the load pressure identifying shuttle 94 will connect the chamber 99 or 100 to the positive load signal port 86. Since chambers 99 and 100 are connected by lines 101 and 102 with cylindrical spaces 48 and 47 of the fluid motor 11 the presence of positive load pressure will be identified by the external logic module 16, with positive load pressure Pp, existing in positive load signal port 86, if the load W is of a positive type. Therefore, the positive load pressure identified by the external logic module 16 is transmitted to the compensating control assembly 12.

The positive load pressure signal, during control of positive load, is transmitted from the positive load signal port 86, through lines 84 and 85 to the fourth control chamber 74, of the positive load pressure compensated control, generally designated as 51, which, in a well known manner, will throttle, by positive load throttling slots 80, the fluid flowing from the inlet chamber 79, connected to the pump 13, to the second fluid supply chamber 77, which in turn is connected by line 78 with the fluid supply chamber 25, to maintain a relatively constant pressure differential across the inflow or positive load pressure metering slots 41 or 42. In this way, in a well known manner, through the action of the positive load compensating control 51, with the constant pressure differential automatically maintained between the supply chamber 25 and the load chamber 26 or 27 the flow through the inflow or positive load metering slots 41 or 42 will be directly proportional to the displacement of the valve spool 19 from its neutral position, irrespective of the magnitude of the positive load W.

During control of negative load, the pressure reducing valve, generally designated as 53, will throttle, by the throttling slots 57, the fluid flow from the inlet chamber 63 to the exhaust chamber 64, to maintain a constant pressure in the exhaust chamber 64. Therefore, the flow of fluid through the outflow or negative load metering slots 43 or 44, during control of negative load, always takes place at a constant pressure, making this flow proportional to the displacement of the valve spool 19 from its neutral position, irrespective of the variation in magnitude of the negative load W.

During control of negative load, as already described, the flow of fluid from the fluid motor 11 is automatically controlled by the negative load pressure control 52 in such a way that it is always proportional to the effective flow areas of the outflow or negative load pressure metering slots 43 or 44. The outflowing fluid from the fluid motor 11, during control of negative load, from one side of the fluid motor must take place, while the required quantity of fluid is supplied from the pump circuit to the other, or inflow side of the fluid motor 11. In a well known manner, the outflow of the fluid motor of a cylinder type is different from the equivalent required inflow, by the volume caused by the displacement of the piston rod 50. Therefore, for any specific displacement of the valve spool 19, flow at different levels will take place through the inflow or positive load pressure metering slots 41 and 42 and through the outflow or negative load pressure metering slots 43 or 44. Since, as described above, the positive load compensating controls 51 and negative load pressure controls 52 of the compensating control assembly 12, automatically maintain either a constant pressure differential across the inflow metering slots 41,42 or maintain a constant pressure upstream of outflow metering slots 43,44 of the valve spool 19, trying to maintain the fluid inflow to the fluid motor 11 equal to the fluid outflow from the fluid motor 11 and since, as already described above, with the fluid motor 11 being of a cylinder type, the inflow and outflow are different, the following parasitic effects will occur during control of negative load.

If the cylindrical space 47 of the fluid motor 11 is subjected to negative load pressure the outflow from the fluid motor 11 will be greater than the equivalent required inflow to cylindrical space 48, and, in a well known manner, the pressure in the cylindrical space 48 will rise to the maximum level, in turn proportionally increasing the negative load pressure in cylindrical space 47, using the energy derived from the pump circuit and will result in not only a very inefficient operation, but in the fluid motor 11 being subjected to excessive pressures.

If the cylindrical space 48, of the fluid motor 11, is subjected to negative load pressure, the outflow from the fluid motor 11 will be smaller than the equivalent inflow and, in a well known manner, the pressure in the cylindrical space 47 will drop below atmospheric and the inlet of the fluid motor 11 will be subjected to cavitation.

In the embodiment of the compensating control assembly 12 of FIG. 1 by subjecting the second control space 60 to the positive load pressure Pp the regulating effect is provided in order to synchronize the control action of the negative load pressure control 52, with the control action of the positive load pressure compensated control 51, irrespective of whether the cylindrical space 47 or 48 of the fluid motor 11 is subjected to negative load pressure, the other cylindrical space of the fluid motor 11 cannot be subjected to either excessive positive load pressures or to the cavitation condition.

The synchronizating action between the positive load compensator 51 and the negative load pressure control 52, is accomplished in the following manner. During control of negative load the negative load pressure reducing valve 53, as described above, automatically maintains the constant pressure, equivalent to the preload of the control spring 59, upstream of the outflow or negative load pressure metering slots 43 or 44. The biasing force, transmitted to the throttling member 55 by the control spring 59, which automatically determines the level of the controlled pressure of the negative load pressure reducing valve 53, is supplemented by the force, equal to the product of the positive load pressure Pp in second control chamber 60 and the cross-sectional area 55*a* of the throttling member 55, thus automatically changing the level of the control pressure of the negative load pressure control 52 and therefore the level of the controlled pressure acting across the outflow or negative load pressure metering slots 43 and 44. In this way, during control of negative load, the pressure, controlled by the negative load control 52, including the negative load pressure reducing valve 53, will proportionally increase with the increase of the inlet pressure in fluid supplied to the fluid motor 11, in turn increasing the flow at negative load pressure through the outflow, or negative load pressure metering slots 43 or 44. In this way the flow through the outflow, or negative load pressure metering slots 43 or 44 becomes a function of the inlet pressure of the fluid motor 11, this inlet pressure automatically seeking an equilibrium condition, at which the quantity of fluid, supplied to the fluid motor 11 through the inflow or positive load pressure metering slots 41 or 42, at a constant pressure differential controlled by the positive load compensating control 51 and equivalent to preload of the control spring 73, will produce an equivalent flow out of the fluid motor, 11, through the outflow or negative load pressure, metering slots 43 or 44, at an increased level of the controlled pressure, acting across those metering slots. This synchronizing and flow equilibrium seeking action, between the compensating controls of the positive load compensator 51 and the negative load pressure reducing valve 53, is made possible by making the level of the pressure, controlled by the negative load pressure reducing valve 53, responsive to the actuator inlet pressure, so that this level of the controlled pressure can be varied in response to the increase in the inlet pressure of the fluid motor 11, while it is automatically maintained constant, at each specific level, as determined by the actuator's inlet pressure. Therefore, through adjustment in the level of the controlled pressure of the negative load pressure reducing valve 53, not only the automatic equilibrium condition between the inlet and outlet actuator flow is established, which automatically compensates for the difference between inlet and outlet actuator flows, as developed in the actuator in the form of a cylinder, but also the variation, due to manufacturing tolerances in the flow areas of the positive and negative load metering slots 41, 42, 43 and 44, is automatically compensated for, while also eliminating all of the parasitic effects, due to variation in timing of the valve spool 19.

The flow areas of the inflow or positive load pressure metering slots 41 or 42 are so selected, that they can supply enough fluid flow into the fluid motor 11, at the constant pressure differential, controlled by the positive load compensator 51, so that the cavitation condition, in cylindrical spaces 47 and 48, can never take place. Then the equivalent outlet flows from the fluid motor 11 are automatically controlled by variation in the pressure, developed upstream of the outflow or negative load pressure metering slots 43 or 44, in response to the pressure at the actuator inlet, so that the actuator inlet pressure, during control of negative load, cannot exceed a certain maximum predetermined value, which is independent of the magnitude of the negative load being controlled. As a result of this specific control feature, induced by the action of the variable pressure negative load pressure reducing valve 53, the controlled flow through the inflow or positive load pressure metering slots 41 or 42, by the positive load compensating control 51, becomes a dominant factor and automatically establishes and controls the velocity of the negative load W.

The negative load pressure reducing valve 53 is provided with a deactivating device, generally designated as 54, which becomes effective during control of positive load and automatically maintains the throttling member 55 in a position, as shown in FIG. 1, providing maximum flow area and therefore minimum throttling loss between the inlet chamber 63 and exhaust chamber 64. The deactivating device 54, due to the presence of the force developed on the cross-sectional area 55*a* of the throttling member 55 by the positive load pressure Pp existing in the second control chamber 60 forcibly maintains the throttling member 55 against the surface 62 in its fully open deactivated position.

The use of the compensating control assembly 12, with its positive load compensating controls 51 and the negative load pressure reducing valve 53 controls the pressure differentials, acting across the metering orifices of the spool of the direction and flow control valve 10, in turn reducing the flow forces acting on the spool. Therefore, under those conditions, the control action of the direction and flow control valve 10 is not influenced by the magnitude of the load pressure and therefore lends itself well to servo valve applications, requiring exact control of flow to and from the fluid motor 11, while providing a high frequency response. Especially in servo systems positioning a tool when very small corrections in the tool position may be required, those small corrections requiring small displacements of the spool of the direction and flow control valve 12. Under those conditions it is preferable to maintain the positive load compensating control 51 and the negative load control 52 in positions regulating minimum flows and therefore with positive throttling slots 80 and negative load throttling slots 57 partially or fully closed. With the valve spool of the direction and flow control valve 10 in neutral position, no load pressure signals are transmitted from the external logic module 16 and the throttling members 55 and 71 of the controls 51 and 52, subjected to the biasing forces of the springs 59 and 73, move into their fully open minimum throttling position.

With the direction and flow control valve 10 in its neutral position and the load pressure identifying shuttle 94 centrally located, as shown in FIG. 1, the fourth control chamber 74 becomes isolated. The leakage control 114 is provided and it interconnects, for small fluid flows, the fourth control chamber 74 with the reservoir 14, through lines 85 and 84. The leakage control 114 can be of a simple orifice type, the flow through which will vary with the positive load pressure Pp, or can be of a compensated flow control type, well known in the art, which will provide a constant leakage from the fourth control chamber 74, irrespective of the magnitude of the load pressure Pp. The leakage control 114 automatically ensures that, in standby conditions, the pressure in the fourth control chamber 74 will be the same as reservoir pressure and the throttling member 71 will be fully displaced to the left, from the position as shown in FIG. 1, isolating, with its cut-off edges 82, the inlet chamber 79 from the second fluid supply chamber 77. In this standby position the throttling member 71, with minimal displacement, is capable of throttling fluid flows at very small flow levels, increasing the frequency response of the control, for small corrections in position of the load W. With the load sensing circuit activated, the flow transmitting capacity of the positive load pressure signals, through the external logic module 16, is so large that the leakage flow, through the leakage control 114, becomes insignificant.

Similarly, with the direction and flow control valve 10 in neutral position and the load pressure identifying shuttle 94 centrally located, the third control chamber 61 becomes isolated and the throttling member 55, under biasing force of the spring 59, will drift towards fully open position, as shown in FIG. 1. Although the negative load pressure is isolated from the exhaust chamber 64, the exhaust chamber 64 is still connected through line 116 with the energizing control 117 connected to a source of pressure. The energizing control 117 may be of an identical construction as that of leakage control 114 and transmits fluid flow, at a very small level, to the negative load circuit. With the pressure from the source 13 of pressure supplying the energizing control 117 being high enough to compress the spring 59 in standby position, the throttling member 55 is maintained in a closed position, with the blocking edges 58 isolating the inlet chamber 63 from the exhaust chamber 64. This action is possible since the second control chamber 60 and the fourth control chamber 74 are interconnected by passage 74*a* and the fourth control chamber is interconnected through leakage control 114 with the system reservoir 14. With the load sensing circuit activated, the flow transmitting capacity of the negative load pressure is so large, that the flow through the energizing control 117 becomes insignificant and does not affect the operation of the controls. Depending on the characteristics of the source of pressure supplying the fluid flow to the energizing control 117 a conventional check valve 115 may be interposed between the energizing control 117 and line 34, to prevent reverse flow through the energizing control 117. Therefore the energizing control 117 ensures that in standby position the throttling member 55, with minimal displacement, is capable of throttling fluid flows at very small flow levels, increasing the frequency response of the control, for small corrections in position of the load W.

Referring now back to FIG. 2, the fluid power and control circuit of FIG. 2 and its basic control components are very similar to those of FIG. 1.

The direction and flow control valve, generally designated as 10, and the external logic module, generally designated as 16, of FIGS. 1 and 2 are identical. The compensating control assembly, generally designated as 118, is very similar to the compensating control assembly 12 of FIG. 1 and performs an identical function in synchronizing the control action of the positive load pressure compensated control 51, which is identical in FIGS. 1 and 2, with the control action of the negative load pressure control, generally designated as 119, which includes a pressure reducing valve, generally designated as 120. The pressure reducing valve 120 of FIG. 2 is very similar to the pressure reducing valve 53 of FIG. 1, the only difference being that the throttling member 121 of FIG. 2, identical in its configuration to the throttling member 55 of FIG. 1, is provided in its extension 70 with bore 122, slidably guiding the reaction piston 124, which is subjected to pressure in space 128. The throttling members 55 and 121 of FIGS. 1 and 2 are subjected to the biasing force of identical control springs 59 and both control by fluid throttling by throttling slots 57 the fluid flow between the inlet chamber 63 and the exhaust chamber 64 to maintain the exhaust chamber 64 at a relatively constant pressure level equivalent to the preload in the control spring 59. The level of the controlled pressure in the exhaust chamber 64 is made responsive, in the control systems of FIGS. 1 and 2, to the positive load pressure signal at Pp pressure, existing in the fourth control chamber 74. The basic difference in the method of variation of the level of the controlled pressure in the exhaust chamber 64, connected to upstream of outflow or negative load pressure metering slots 43 and 44, between the controls of FIGS. 1 and 2, lies in the magnitude of the force transmitted by the positive load pressure Pp to the throttling members 55 and 121 of FIGS. 1 and 2, during control of negative load.

In FIG. 1 the force, generated by the positive load pressure Pp, which varies the level of the control pressure of the pressure reducing valve 53, and which is directly transmitted to the throttling member 55, is equal to the product of the cross-sectional area of the throttling member 55*a* and Pp pressure.

In FIG. 2 the force generated by the positive load pressure Pp, which varies the level of the control pressure of the pressure reducing valve 120, and which is directly transmitted to the throttling member 121, is equal to the product of the cross-sectional area of the cylindrical section 123, of the reaction piston 124 and Pp pressure.

Since the cross-sectional area of the reaction piston 124 is very much smaller than the cross-sectional area of the throttling member 55 of FIG. 1, a much greater increase in Pp pressure is needed for any specific increase in the level of the control pressure in the exhaust chamber 64. Therefore, by selecting any specific cross-sectional area of the reaction piston 124, the specific relationship between Pp pressure and the level of the control pressure in the exhaust chamber 64 can be established. To transmit to the throttling member 121 a specific force, proportional to Pp pressure and cross-sectional area of the reaction piston 124, the chamber 130 must be vented to reservoir pressure. The space 128 is connected by passages 129 and 74*a* with the fourth control chamber 74. The area of sealing surface 126, abutting against reaction surface 127 and surrounding the circular area of passage 129, is so selected, that the force generated on the sealing surface 126, due to Pp pressure and logarithmic pressure gradient, well known in the art, will be smaller than the preload in the control spring 59. In this way the sealing surface 126 will be maintained in contact with the reaction surface 127, with only minimal leakage taking place across the sealing surface 126.

Referring now back to FIG. 3, the fluid power and control circuits of FIGS. 1, 2 and 3 and their basic control components are very similar.

The external logic module 16 is identical in all three figures. Also all three figures use the identical positive load pressure compensated control 51, although in FIGS. 1 and 2 this control is integrated into single compensating control assemblies 12 and 118, while in FIG. 3 the positive load pressure compensated control 51 is shown as a self-contained control. Again the pressure reducing valve 53 of FIG. 1 is identical to the pressure reducing valves 135 and 136, all of those pressure reducing valves using identical throttling member 55. However, the negative load pressure control, generally designated as 132 of FIG. 3 uses two identical pressure reducing valves 135 and 136, positioned back to back in the control chamber 138 and biased, towards position as shown, by the single control spring 137. The basic control characteristics of the pressure reducing valves 135 and 136 of FIG. 3 are identical to that of FIG. 1. The reason for the use of two pressure reducing valves is that the direction and flow control valve, generally designated as 141, is provided with a spool having the outflow or negative load throttling slots 142 and 143 located on individual lands 144 and 145. The reason for the use of two pressure reducing valves, controlling the fluid flow at negative load pressure through two individual metering slots, is as follows. The frequency response of the pressure reducing valve is strictly related to the volume of oil contained between the throttling slots of the throttling member and the metering slot on the direction control spool. The arrangement of FIG. 3 permits this critical parameter of volume to be very much smaller than the volume of the arrangements of FIGS. 1 and 2, thus providing a much higher frequency response of the controls of FIG. 3. Since only one of the two pressure reducing valves can work at a time, a single control spring 137 can be used and the throttling members 55 are separated by a distance, equal to the length of the control stroke of the throttling member 55. Since the control chamber 138 is connected by line 140, the fourth control chamber 74 and line 84 to the positive load signal port 86, the pressure reducing valves 135 and 136 are responsive, in an identical way as that of pressure reducing valve 53 of FIG. 1, to the positive load pressure, which varies in an identical way the level of the controlled pressure, upstream of the metering slots 142 and 143, to synchronize the positive and negative load controls, during control of negative load.

Referring now back to FIG. 4, the negative load pressure control, generally designated as 176, is directly mounted on the fluid motor 175 and is a part of the fluid motor assembly, generally designated as 174. The fluid flow to and from the fluid motor 175, which is in the form of a cylinder, is controlled by the direction control valve assembly, generally designated as 159, which is supplied with fluid under pressure from pump 13, through a positive load pressure compensating control, shown schematically and designated as C, which may be of a type as shown as 51 in FIGS. 1, 2 and 3, which is well known in the art and is of a throttling type, as shown in FIG. 5, or of a bypass and throttling type, as shown in FIG. 6.

The spool 160 of the direction control valve assembly 159 is provided with positive load metering slots 166 and 167 and negative load metering slots 168 and 169. The basic function of those metering slots of FIG. 4 is identical to the equivalent metering slots of FIGS. 1, 2 and 3 with essentially a constant pressure differential being maintained by the positive load compensating control C, while the pressure upstream of the negative load metering slots 168 and 169 is maintained at a constant level by the negative load pressure reducing valve 189, the throttling member 190 of which, both in its configuration and operation, is identical to the throttling member 55 of FIGS. 1 and 3.

The throttling member 190 is biased towards position as shown by the spring 192 and by the force developed on the cross-sectional area of the force input piston 198, subjected to pressure in the load chamber 162. The load W is unidirectional and acts in a downward direction. Therefore, in the fluid motor 175 the negative load is only controlled from the cylindrical space 179. Therefore, through the force transmitting action of the force input piston 198, when lowering the load W, the control pressure level, upstream of the negative load metering slot 168, is regulated in response to the pressure existing in the cylindrical space 180, providing a synchronizing effect between the controls of positive and negative load.

During raising of the load W the valve spool 160 is moved from left to right, connecting the supply chamber 163 with the load chamber 161 through the positive load metering slot 166. The fluid flow from the load chamber 161 will pass through line 170 to chamber 183, will lift the check valve 184 and be supplied through chamber 185 and throttling ports 186, to the chamber 187 and therefore to the cylindrical space 179 of the fluid motor 175. The velocity of the positive load W will be controlled, in a well known manner, by the positive load compensator control C and will be proportional to the displacement of the valve spool 160 from its neutral position. The flow out of the fluid motor 175, from cylindrical space 180, through passages 181 and 182 and lines 172 and 171 will be delivered to the load chamber 162 and will pass through the negative load metering slot 169 to the reservoir 14. The resistance to flow of the negative load metering slot 169 will automatically establish the required pressure in the outflow circuit of the fluid motor 175, which pressure is generated from the energy derived from the pump 13. During raising of the load W the connecting valve 201 will remain in position, as shown in FIG. 4, since its connecting spool 202 is subjected to the positive load pressure in the chamber 183 and preload of the spring 206. Also the throttling member 189 will remain in the position as shown in FIG. 4, since the cross-sectional area of both of its ends is subjected to positive load pressure, thus cancelling each other forcewise, while also being subjected to the biasing force of the spring 192. Therefore, the pressure reducing valve 189 becomes completely inactive, providing maximum area of flow to the throttling ports 186. The force input piston 198, subjected to positive load pressure in the chamber 183 and low pressure in space 200, will move from right to left, out of engagement with the extension 197 of the throttling member 190.

During the control of negative load, while the load W is being lowered, the valve spool 160 is moved from right to left, connecting the load chamber 162 with the supply chamber 163 through positive load metering slot 167, while also connecting the load chamber 161 with the outlet chamber 164, through negative load metering slots 168. The rising pressure in the load chamber 162 is transmitted through lines 171 and 172 to the passage 182, where at a pressure, equivalent to the preload in the spring 206, it will move the connecting spool 202 from right to left, interconnecting through connecting ports 204 the chamber 185 with the chamber 183, which in turn is connected by line 170 to the load chamber 161 and therefore to the upstream of the negative load metering slots 168. In a manner as previously described when referring to FIGS. 1, 2 and 3, the throttling member 190 will be maintained in an equilibrium position, maintaining the pressure in chamber 185 and therefore in control chamber 194 at a constant pressure level, equivalent to the preload in the spring 192. Therefore, flow of fluid will take place from the chamber 185 through connecting ports 204, the chamber 183, line 170 and negative load metering slots 168 to the system reservoir. Therefore, the load chamber 161 will be maintained at a certain constant pressure level by the negative load pressure reducing valve 189. Since, the flow through the negative load metering slot 168 is supplied from cylindrical space 179, the load W is lowered, while the inlet flow to the cylindrical space 180 is supplied through positive load metering slot 167, maintained at a constant pressure differential by the positive load compensating control C. The area of the positive load metering slot 167 is so selected that at the controlled pressure differential it supplies higher flow to the cylindrical space 180 than the equivalent flow from the cylindrical space 179, which is regulated by the pressure in the load chamber 161, upstream of the negative load metering orifice 168 and equivalent to the preload in the spring 192. Under those conditions the pressure in the cylindrical space 180 will continue to rise. This pressure is transmitted through line 173 to space 200 and reacts on the cross-sectional area of the force input piston 198, which engages the extension 197 of the throttling member 190 and transmits additional force to the throttling member 190, supplementing the force of the spring 192. In this way, in a manner as previously described, the controlled pressure level in the load chamber 161 will start to rise, with the rise in pressure in cylindrical space 180, increasing the flow through the negative load metering slots 168, until the condition of equilibrium is reached, at which the inflow to the positive load metering slot 167 is exactly equivalent to the outflow through the negative load metering slot 168, while the pressure in the cylindrical space 180 remains constant. Under those conditions the inlet and outlet flow controls to the fluid motor 175 are completely synchronized and the velocity of the load W becomes a function of the displacement of the valve spool 160. In this condition of synchronization cylindrical space 180 is maintained at a minimum pressure level, eliminating the possibility of cavitation, while the negative load pressure in the cylindrical space 179 is again maintained at minimum negative load presure, preventing the possibility of fluid motor 175 being subjected to excessive pressures, during control of negative load.

In neutral position of valve spool 160, as shown in FIG. 4, the throttling member 190, of the negative load pressure reducing valve 189, drifts from right to left, isolating the chambers 187 and 185, the connecting spool 202 remains in the position as shown in FIG. 4, isolating the chambers 185 and 183, while those chambers are also isolated by check valve 184.

When controlling either positive or negative load, with line 170, which usually is in the form of a flexible rubber hose, ruptured, pressure in the chamber 183 drops suddenly. This pressure drop in the chamber 183 is, in a well known manner, due to resistance of the metering slots, followed by the drop in pressure in the cylindrical space 180 and passage 182. Under those conditions the connecting spool 202, biased by the spring 206 moves into the position as shown in FIG. 4, isolating the chamber 185 from the chamber 183, while the check valve 184 also isolates those chambers, thus isolating the cylindrical space 178 from the broken line 170. By supplying the flow through the displacement of the valve spool 160 from the pump to the passage 182, the control of negative load reducing valve 189 is activated, the connecting spool 202 is maintained in an open position, connecting the chambers 185 and 183 and the load W can be lowered with controlled velocity, as dictated by the positive load compensator C, the flow through the positive load throttling slots determining the velocity of the load.

Referring now back to FIG. 5, the throttling and bypass member of the compensating control 208, in a well known manner, maintains a constant pressure differential between the pressure in the inlet chamber 79 and the fourth control chamber 74, which is connected, through line 84, with the positive load identifying circuit of the external logic module 16 of FIG. 1 or of the other figures. The level of this constant pressure differential is dictated by the preload in the control spring 73 and is controlled by the throttling action of the throttling and bypass slots 212, diverting the flow from the pump 13, which may be of a constant displacement type, to the exhaust chamber 213 and therefore to the system reservoir 14.

Referring now back to FIG. 6, the throttling and bypass member 208 of the compensating control 217, in a well known manner, maintains a constant pressure differential between the second fluid supply chamber 77 and the fourth control chamber 74, which is supplied with fluid at positive load pressure through line 94 from the external logic module 16 of FIG. 1, or of the other figures. The control of the pressure differential is obtained either through the throttling action of the positive load throttling slots 80, or through the bypass action of bypass and throttling slots 219. The bypass and throttling action of the bypass and throttling slots 219 permit the excess flow from the pump 13 to be passed to the bypass chamber 220, which is connected in series by line 221 with the series circuit 222. With the positive load control of FIG. 6 the direction and flow control valve 10, connected to the second flow control chamber 77, has an automatic flow priority over the control valves of series circuit 222, since only the excess flow, over that required by the direction and flow control valve 10, can be passed to the series circuit 222.

The positive load controls of FIGS. 5 and 6 are integrated in an identical way with negative load compensating controls and regulating controls of FIGS. 1 and 2 and result in identical control characteristics of the control systems of FIGS. 1 and 2, since, through different actions, they still maintain the constant pressure differential, between the positive load pressure and the pressure upstream of the positive load pressure metering slots.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

I claim:

1. A valve assembly interposed between a fluid motor operable to control positive and negative loads and subjected to positive and negative load pressure, fluid exhaust means including reservoir means and a source of pressure connected to a pump, first valve means operable to selectively interconnect said fluid motor with said exhaust means and said source of pressure, positive load pressure control means between said fluid motor and said pump, negative load pressure control means between said fluid motor and said exhaust means including pressure reducing valve means and fluid outflow metering orifice means, said pressure reducing valve means having throttling member means operable to control the flow of fluid through any specific flow area of said fluid outflow metering orifice means at a relatively constant control pressure upstream of said fluid outflow metering orifice means independent of the magnitude of said negative load pressure, and regulating means responsive to said positive load pressure operable to increase said control pressure upstream of said fluid outflow metering orifice means with increase in said positive load pressure whereby fluid flow through said fluid outflow metering orifice means becomes independent of the magnitude of said negative load pressure and can be increased with the increase in said positive load pressure during control of said negative load.

2. A valve assembly as set forth in claim 1 wherein said throttling member means has throttling slot means positioned upstream of said fluid outflow metering orifice means.

3. A valve assembly as set forth in claim 1 wherein said positive load pressure control means includes fluid inflow metering orifice means.

4. A valve assembly as set forth in claim 3 wherein said regulating means has force generating means responsive to pressure downstream of said fluid inflow metering orifice means.

5. A valve assembly as set forth in claim 3 wherein said regulating means has deactivating means of said pressure reducing valve means when pressure at said fluid inflow metering orifice means reaches a certain predetermined level.

6. A valve assembly as set forth in claim 1 wherein said positive load pressure control means includes fluid inflow metering orifice means and positive load pressure compensating control means upstream of said fluid inflow metering orifice means said compensating control means having throttling means operable to control the pressure differential across said fluid inflow metering orifice means at a relatively constant preselected level.

7. A valve assembly as set forth in claim 6 wherein said positive load pressure compensating control means includes compensation energizing means whereby said compensating control means is maintained in minimum flow throttling position in anticipation of positive load compensating action.

8. A valve assembly as set forth in claim 1 wherein said positive load pressure control means includes fluid inflow metering orifice means and positive load pressure compensating control means upstream of said inflow metering orifice means operable to control bypass flow between said pump and said exhaust means to control the pressure differential across said inflow metering orifice means at a relatively constant preselected level.

9. A valve assembly as set forth in claim 1 wherein said positive load pressure control means includes fluid inflow metering orifice means, and positive load pressure compensating control means upstream of said fluid inflow metering orifice means said compensating control means having fluid throttling slot means between said pump and said fluid motor and bypass throttling means between said fluid pump and a series power circuit said positive load pressure control means operable to control the pressure differential across said fluid inflow metering orifice means at a relatively constant preselected level.

10. A valve assembly as set forth in claim 1 wherein logic means has pressure identifying means operable to identify the presence of said positive load pressure and first transmitting means operable to transmit control signal of said identified positive load pressure to said positive load pressure control means and to said regulating means.

11. A valve assembly as set forth in claim 10 wherein said pump has an output flow control responsive to said positive load pressure and said logic means has second transmitting means operable to transmit control signal of said identified positive load pressure to said output flow control of said pump.

12. A valve assembly as set forth in claim 1 wherein said pressure reducing valve means includes energizing means whereby said pressure reducing valve means is maintained in minimum flow throttling position in anticipation of negative load control action.

13. A valve assembly as set forth in claim 1 wherein said pressure reducing valve means has mounting means on said fluid motor.

14. A valve assembly as set forth in claim 1 wherein said negative load pressure control means includes a fluid bypass means operable to supply fluid flow from said source of pressure to said fluid motor.

15. A valve assembly as set forth in claim 1 wherein said negative load pressure control means has fluid flow blocking means operable to prevent fluid flow from said fluid motor to said fluid exhaust means when said positive load pressure drops below a certain predetermined level.

16. A valve assembly interposed between a fluid motor operable to control positive and negative loads and subjected to positive and negative load pressure, fluid exhaust means including reservoir means and a source of pressure connected to a pump, first valve means operable to selectively interconnect said fluid motor with said exhaust means and said source of pressure, fluid inflow metering orifice means interposed between said fluid motor and said pump, positive load pressure compensating control means upstream of said fluid inflow metering orifice means operable to maintain by fluid throttling a relatively constant pressure differential across said fluid inflow metering orifice means, negative load pressure control means between said fluid motor and said reservoir means including pressure reducing valve means and fluid outflow metering orifice means, said pressure reducing valve means having throttling member means operable to control the flow of fluid through any specific flow area of said fluid outflow metering orifice means at a relatively constant control pressure upstream of said fluid outflow metering orifice means independent of the magnitude of said negative load pressure, and regulating means responsive to said positive load pressure operable to increase said control pressure upstream of said fluid outflow metering orifice means with increase in said positive load pressure whereby during control of negative load a relatively constant pressure differential is maintained across said fluid inflow metering orifice means while the pressure level at said fluid inflow metering orifice means is limited to a certain predetermined level.

17. A valve assembly as set forth in claim 16 wherein said compensating control means includes fluid throttling slot means interposed between said pump and said fluid motor.

18. A valve assembly as set forth in claim 16 wherein said compensating control means includes fluid bypass throttling means interposed between said pump and said reservoir means.

19. A valve assembly as set forth in claim 16 wherein said compensating control means includes fluid throttling slot means interposed between said pump and said fluid motor and bypass throttling means interposed between said pump and a series power circuit.

20. A load responsive valve assembly comprising a compensating control assembly and a first valve means having first and second load chambers connected to a fluid motor operable to control positive and negative loads and subjected to positive and negative load pressure, an inlet chamber of the compensating control assembly connected to a fluid pump, outlet chambers operably connected to reservoir means, and a supply chamber, valve spool means operable to sequentially interconnect said load chambers with said supply chamber and said outlet chambers, fluid inflow metering orifice means on said valve spool means operable to meter fluid flow between said supply chamber and said load chambers, compensating control means interposed between said inlet chamber and said supply chamber operable to maintain a relatively constant pressure differential across said fluid inflow metering orifice means during control of said positive and said negative load, logic means operable to identify the presence of positive load pressure in said load chambers and to transmit a positive load pressure signal to said compensating control means, pressure reducing valve means operable to throttle said negative load pressure from said outlet chambers to a relatively constant control pressure level, fluid outflow metering orifice means interposed between said pressure reducing valve means and said reservoir means, and regulating means of said pressure reducing valve means having force generating means responsive to pressure downstream of said fluid inflow metering orifice means and operable to vary the level of said control pressure while said control pressure is maintained constant by said pressure reducing valve means at each selected level.

21. A load responsive valve assembly as set forth in claim 20 wherein said fluid outflow metering orifice means is positioned on said valve spool means.

22. A load responsive valve assembly as set forth in claim 20 wherein said regulating means has force limiting means operable to limit said pressure downstream of said fluid inflow metering orifice means to a certain maximum pressure level during control of said negative load.

23. A valve assembly as set forth in claim 20 wherein said compensating control means includes fluid throttling slot means interposed between said pump and said fluid motor.

24. A valve assembly as set forth in claim 20 wherein said compensating control means includes fluid bypass throttling means interposed between said pump and said reservoir means.

25. A valve assembly as set forth in claim 20 wherein said compensating control means includes fluid throttling slot means interposed between said pump and said fluid motor and fluid bypass throttling means interposed between said pump and a series power circuit.

26. A valve assembly as set forth in claim 20 wherein said regulating means of said pressure reducing valve means has force generating means responsive to pressure downstream of said fluid inflow metering orifice means.

27. A valve assembly as set forth in claim 26 wherein said force generating means has deactivating means operable to deactivate said pressure reducing valve means when pressure of said positive load pressure signal reaches a certain predetermined level.

28. A load responsive valve assembly as set forth in claim 20 wherein said pressure reducing valve means includes first pressure reducing valve means and second pressure reducing valve means.

29. A load responsive valve assembly as set forth in claim 28 wherein said first pressure reducing valve means is interposed between said outlet chamber and first fluid outflow metering orifice means and said second pressure reducing valve means is interposed between said outlet chamber and second fluid outflow metering orifice means.

30. A load responsive valve assembly as set forth in claim 28 wherein said first and second pressure reducing valve means have throttling member means and spring biasing means interposed between said throttling member means.

* * * * *